United States Patent [19]

Edelhoff et al.

[11] Patent Number: 4,715,767

[45] Date of Patent: Dec. 29, 1987

[54] MOTOR-DRIVEN GARBAGE TRUCK COMPRISING A DETACHABLE CONTAINER

[75] Inventors: Gustav D. Edelhoff, Iserlohn, Fed. Rep. of Germany; Fred I. Smith, Palos Verdes Pen, Calif.

[73] Assignee: Edelhoff Polytechnik GmbH & Co., Iserlohn, Fed. Rep. of Germany

[21] Appl. No.: 733,865

[22] Filed: May 14, 1985

[30] Foreign Application Priority Data

May 29, 1984 [DE] Fed. Rep. of Germany ..... 3420058

[51] Int. Cl.[4] ..... B65F 3/04

[52] U.S. Cl. ..... 414/408; 294/68.26; 414/407; 414/477; 414/517; 414/680; 414/687

[58] Field of Search ..... 414/406–408, 414/477–480, 491–494, 497, 498, 511, 509, 517, 525 R, 665–671, 687, 728, 729, 680, 744 A, 744 R; 180/322; 294/68.26

[56] References Cited

U.S. PATENT DOCUMENTS

| | | | |
|---|---|---|---|
| Re. 31,060 | 10/1982 | Lutz | 414/28 |
| 2,708,047 | 5/1955 | Seidle | 414/477 |
| 2,799,418 | 7/1957 | Haldimann | 414/670 |
| 2,975,851 | 3/1961 | Youmans et al. | 180/6.2 |
| 3,014,344 | 12/1961 | Arnot | 414/635 X |
| 3,016,175 | 1/1962 | Wareham et al. | 226/58 |
| 3,085,703 | 4/1983 | Dempster et al. | 414/406 |
| 3,241,687 | 3/1966 | Orloff | 414/5 |
| 3,301,422 | 1/1967 | Hendricks | 414/670 |
| 3,339,763 | 9/1967 | Caywood et al. | 414/694 |
| 3,342,358 | 9/1967 | French et al. | 414/408 X |
| 3,446,377 | 5/1969 | Heinert | 414/408 |
| 3,451,571 | 6/1969 | Brisson | 180/322 X |
| 3,506,149 | 4/1970 | Gray | 414/701 |
| 3,563,137 | 2/1971 | Graber et al. | 414/700 |
| 3,604,577 | 9/1971 | Hellmeier | 414/728 X |
| 3,659,733 | 5/1972 | Sinclair et al. | 414/670 |
| 3,765,554 | 10/1973 | Morrison | 414/408 |
| 3,874,534 | 4/1975 | Brisson | 414/406 |
| 3,888,362 | 6/1975 | Fletcher et al. | 414/620 |
| 3,966,096 | 6/1976 | Worthington | 414/525 X |
| 4,041,799 | 8/1977 | Teti | 414/525 X |
| 4,067,464 | 1/1978 | Parks et al. | 414/492 |
| 4,091,944 | 5/1978 | Gollnick | 414/407 |
| 4,096,595 | 6/1978 | Eide et al. | 5/471 |
| 4,096,959 | 6/1978 | Schaffler | 414/408 |
| 4,147,266 | 4/1979 | Corompt | 414/480 |
| 4,175,903 | 11/1979 | Carson | 414/408 |
| 4,183,711 | 1/1980 | Schaeff | 414/687 X |
| 4,295,740 | 10/1981 | Sturges, Jr. | 356/152 |
| 4,310,279 | 1/1982 | Johnston | 414/408 |
| 4,423,998 | 1/1984 | Inaba et al. | 414/744 A X |
| 4,544,320 | 10/1985 | Haines | 414/517 X |
| 4,552,500 | 11/1985 | Ghibaudo et al. | 414/408 |

FOREIGN PATENT DOCUMENTS

| | | | |
|---|---|---|---|
| 797644 | 10/1968 | Canada . | |
| 1238841 | 4/1967 | Fed. Rep. of Germany | 414/406 |

*Primary Examiner*—Joseph E. Valenza
*Assistant Examiner*—David A. Bucci
*Attorney, Agent, or Firm*—Morgan & Finnegan

[57] ABSTRACT

A motor-driven garbage truck provided with a detachable garbage container equipped with releasable coupling elements, and also having permanently mounted thereon which includes a pouring chute in the forward portion, lifting and tipping apparatus for picking up a garbage can and discharging the contents thereof into the chute leading to a receiving space, and a conveying and compacting apparatus for transferring the garbage from the receiving space into the container through the receiving opening, which is provided with a closure is disclosed. The pouring unit is disposed in part above the driver's cab and in part between the cab and the container, the chute being disposed in a region extending behind and above the cab. The lifting and tipping apparatus includes at least one lifting arm, pivotally movable about a transverse pivot carried by the pouring unit or the chassis of the vehicle. The lifting arm carries at its free end a carrying rail, which is parallel to the tranverse pivot and pivotally movable between a pick-up position, in which the rail is disposed below and in front of the driver's cab, and a pouring position, in which the rail is disposed above and behind the cab. The rail is provided with a displaceable or pivotally movable, extensible coupling or gripping member for coupling to or gripping a garbage can placed on the street.

12 Claims, 14 Drawing Figures

A
B

MOTOR-DRIVEN GARBAGE TRUCK COMPRISING A DETACHABLE CONTAINER

BACKGROUND OF THE INVENTION

1. Field of the Invention

This invention relates to a motor-driven garbage truck comprising a detachable garbage container provided with separable coupling elements, a pouring unit, which is permanently mounted on the truck and includes a pouring chute in the forward portion thereof, lifting and tipping apparatus for picking up a garbage can and discharging the contents thereof into the chute leading to a receiving space, and a conveying and compacting apparatus for transferring the garbage from the receiving space into the container through its receiving opening, which is provided with a closure.

2. Description of the Prior Art

A garbage truck is known from German patent specification No. 24 58 903 in which there is disclosed a system for collecting garbage in detachable containers and transporting the garbage-filled containers to a central container-handling station where the filled containers are replaced by empty ones, and from which station the filled containers are transported by forwarding trucks to the dumps. The known garbage truck is specifically designed for the collection of garbage and economically performs that operation because it is never used to carry the filled containers to the dumps. However, in the known garbage truck, the conveyers leading from the chute to the receiving opening of the container extend under the driver's cab, so that the latter is disposed on a relatively high level. Thus, the driver does not have a good view of the street and the garbage cans placed alongside the street. In addition, the garbage cans to be emptied must be moved to a location at the front end of the garbage truck before they can be picked up and tipped by the lifting and tipping apparatus.

SUMMARY OF THE INVENTION

It is an object of this invention to provide a garbage truck of the kind first described hereinbefore which is so improved that the garbage cans placed on the street can be coupled to the lifting and tipping apparatus and emptied into the chute in a simple manner without moving them to a location at the front end of the truck, so that the collecting work can be performed by the driver alone.

This object is accomplished, in part, in accordance with the invention by providing a pouring unit which is disposed in part above the driver's cab of the garbage truck and in part between the driver's cab and the container, the chute thereof being disposed in a region extending behind and above the driver's cab and including lifting and tipping apparatus which comprises at least one lifting arm pivotally movable about a transverse pivot carried by the pouring unit or the chassis of the vehicle, the lifting arm carrying at its free end a carrying rail which is parallel to the transverse pivot and pivotally movable between a pick-up position, in which the rail is disposed below and in front of the driver's cab, and a pouring position, in which the rail is disposed above and behind the driver's cab, the rail being provided with displaceable and/or pivotally movable, extensible means such as a coupling or gripping member for coupling to or gripping a garbage can placed on the street. In view of the fact that the pouring unit is disposed above and behind the driver's cab, the cab can be so arranged to provide the driver with an optimum view of the street and the garbage cans placed alongside the street. The driver can collect the garbage by himself without the assistance of other persons and without leaving his seat since the lifting and tipping apparatus is provided with means which can be controlled by the driver from his seat and which can be coupled to or grip a garbage can which has been placed near the route of the truck. As a result, each garbage can can be picked up, tipped, emptied and returned to the street without need for manual work. For this reason, the garbage truck in accordance with the invention, facilitates the collection of garbage and permits such collection to be carried out by a single person and the truck to be utilized to a high degree of efficiency.

Since garbage trucks must often move in narrow and crooked streets, the garbage truck in accordance with the invention suitably has a short wheelbase for high maneuverability.

In a garbage truck according to this invention, the driver have a particularly good view of the street and of the garbage cans placed alongside the street since the driver's cab is disposed on the lowest possible level in front of the front axle of the truck. The garbage truck is suitably provided with left-hand and right-hand steering wheels so that in normal street traffic, e.g., when moving to the central container-handling station or to a nearby dump, the driver can use the left-hand steering wheel, but during the collection of garbage from garbage cans placed along the right side of the street, he can use the right-hand steering wheel.

In accordance with a further feature of the invention the lifting arm consists of two U-shaped members disposed on opposite sides of the driver's cab, each comprising a short leg and a long leg, the transverse pivot for the lifting arm being disposed near the free ends of the short legs and the coupling members carrying the carrying rail being pivoted at one end to the free ends of the long legs, whereas the other ends of the coupling members are connected to the pouring unit or the garbage truck by means of coupling rods that are pivotally attached to levers mounted adjacent to the inner ends of the legs. The connections of the other ends of the coupling members to the pouring unit or the garbage truck are so arranged that the carrying rail when pivotally moving to a position above and in front of the driver's cab will undergo substantially no rotation relative to the driver's cab, but will perform an accelerated rotary movement during its remaining pivotal movement to the chute, such arrangement being also suitable for use in other garbage trucks. The described kinematic arrangement of the lifting and tipping apparatus ensures that there will be substantially no rotation of the garbage can during the major part of the lifting movement so that no garbage can fall out of the can. The accelerated rotation or turning movement during the last part of the movement towards the chute and an impact of the lifting arms or of the garbage can against a stop, or a braking of the movement, during the final phase of the pouring movement, or even an accelerated reverse movement of the garbage can will have the effect of virtually throwing the garbage from the can into the chute.

In accordance with another feature of the invention, a link is eccentrically mounted on the carrying rail for pivotal movement about a vertical axis. At its free end the link is provided with a claw for picking up a garbage can, the claw being pivotally movable between an outer position and an inner position in which it engages the carrying rail. Due to such arrangement, the driver of the garbage truck can cause the gripping or coupling elements of the lifting and tipping apparatus to grip, tip and return garbage cans standing on the side of the street. The gripping claw suitably consists of a member having the configuration of an isosceles triangle, which has an upwardly directed apex and which is pivoted on a vertical pin of the coupling member. The claw can be introduced into a correspondingly shaped receiving groove on the garbage can and will center itself during such operation.

In accordance with a preferred further feature, the pick-up claw is guided by and axially displaceable on the vertical pin against a spring force and is locked to that pin when the claw is in its lowermost end position. During the introduction of the gripping claw into the receiving groove, the pick-up claw centers itself as it engages the adjacent wall of the can. The pick-up claw will be latched to the carrying pin under the weight of the garbage can which has been gripped. As a result, the garbage can is fixed to the carrying rail of the lifting and tipping apparatus by means of a latching member during the tipping of the can.

In accordance with a particularly advantageous feature, either the link and the auxiliary link are, or only the main link is, movably mounted on a carrier or on a profiled sleeve which is displaceably mounted on the carrying rail and can be extended beyond at least one end of the rail. The sleeve can be extended by special drive means and can be used for gripping and tipping garbage cans even when they have been placed at a relatively distant point from the side of the garbage truck.

In accordance with another feature of the invention, the transfer and compacting chamber is disposed below the receiving space and contains a compacting ram which conforms in cross-section to the chamber configuration and is reciprocable therein by means of laterally disposed toggle joints which are pivoted to the rear end of the ram and adjacent to the rear wall of the chamber. Crossing hydraulic piston-cylinder units are provided, each of which is pivoted at one end to the hinge of each one of the toggle joints and which is pivoted at its other end adjacent to the stationary pivots of the respective other toggle joint. The described conveying and compacting apparatus permits the garbage to be initially pushed into the containers at a relatively high speed and during the final part of the pushing movement, the ram will move at a lower speed and exert a stronger force on the garbage to compact it. A special advantage resides in the fact that the ram is moved by a mechanism which comprises toggle joints and fluid-operable piston-cylinder units which can be retracted to a very small axial length so that the mechanism is compact and economical.

In accordance with another advantageous feature, an auxiliary frame lies on and is pivoted to the main chassis frame, the container being releasably latched to the auxiliary frame and the auxiliary frame is pivoted on pins which are displaceable in slots formed in the rear portion of the main frame. The auxiliary frame is provided at its forward end with a nose which extends below and engages a stop plate on the main frame when the nose is at the forward end position of the auxiliary frame. The auxiliary and main frames are interconnected by an inclined hydraulic piston-cylinder unit in such a manner that the nose is disengaged from the overlying stop before the pivotal movement of the auxiliary frame begins. Due to such arrangement, the container can be emptied by pivotal movement of the auxiliary frame in the conventional manner. In addition, the container can be detached from the auxiliary frame by means of quick-acting couplings so that the filled containers can quickly and easily be replaced by empty containers in the system for collecting garbage in detachably mounted containers.

BRIEF DESCRIPTION OF THE DRAWINGS

Further advantageous features of the invention will be apparent from the following description thereof taken in conjunction with the accompanying Drawings wherein.

DETAILED DESCRIPTION OF THE PREFERRED EMBODIMENT

An illustrative embodiment of the invention will now be explained more in detail with reference to the Drawings.

Figure 1:
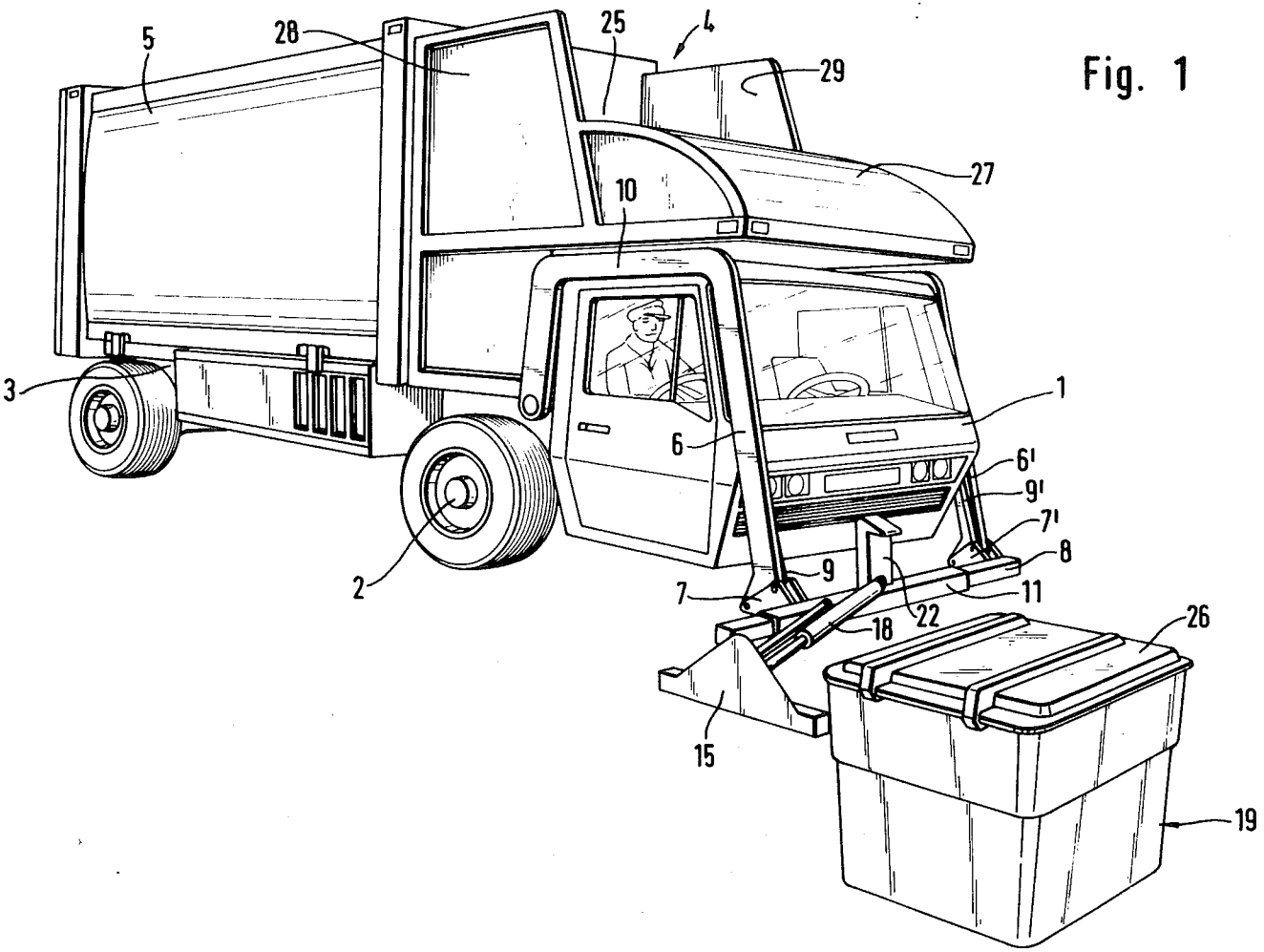
FIG. 1 is a perspective view showing a garbage truck approaching a garbage can to be emptied.
Figure 2:
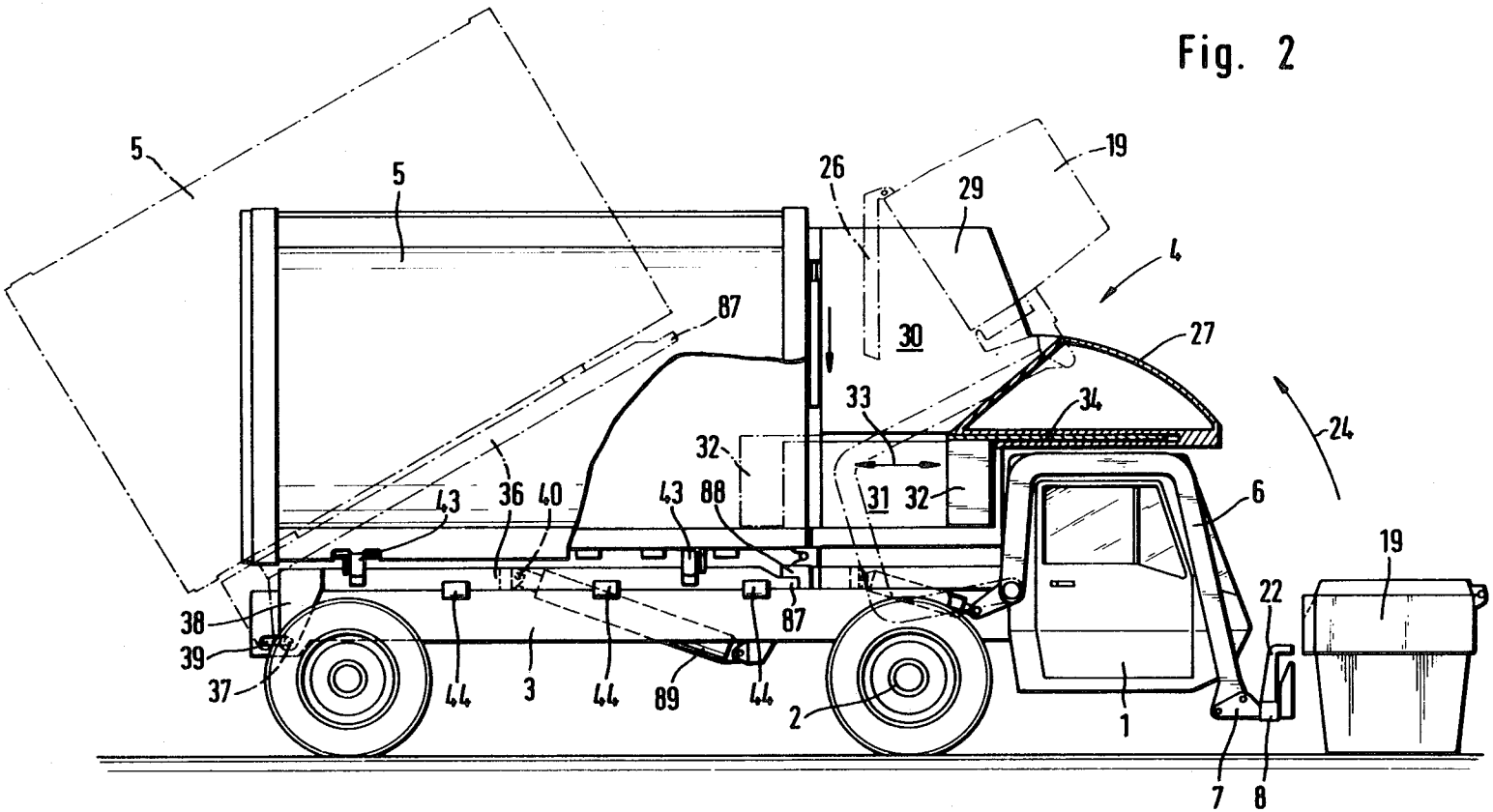
FIG. 2 is a side elevation showing partially in a diagrammatical sectional view the garbage truck of FIG. 1.
Figure 3:
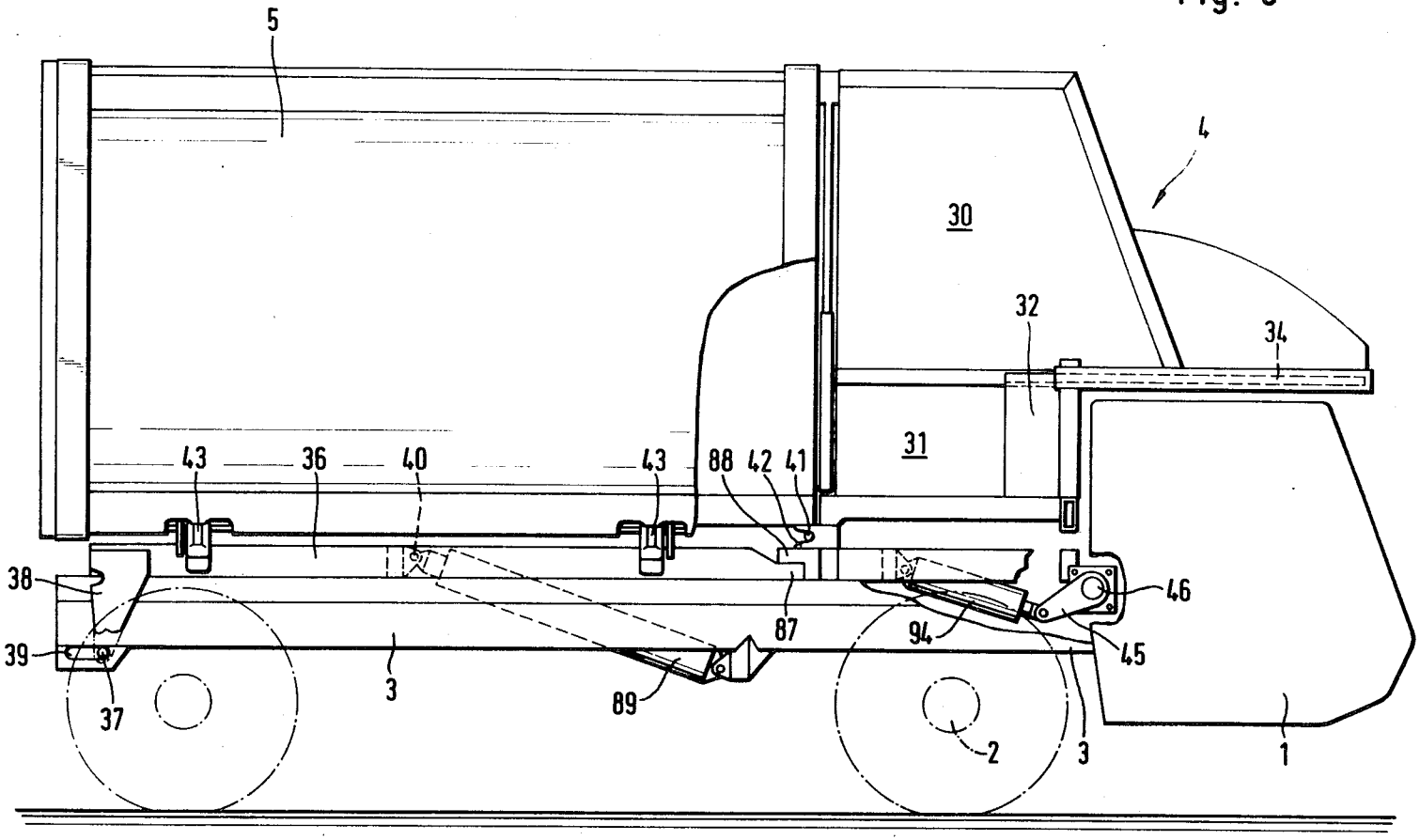
FIG. 3 is a side elevation similar to FIG. 2 and shows the garbage truck in section so that details become more clearly apparent.

A garbage truck of a system for collecting garbage in detachably mounted containers is generally shown in FIGS. 1 to 3. The truck has a short wheelbase for high maneuverability during the collection stage. The driver's cab 1 is secured to the main frame 3 of the chassis and is disposed on a low level in front of the front axle 2. The bottom of the driver's cab is disposed on or below the level of the wheel axles so that the driver has a good view of garbage cans placed alongside the street. As is apparent from FIG. 1 the garbage truck is provided with two steering wheels for left-hand and right-hand steering. During normal traffic in the street, the driver can use the left-hand steering wheel. For the collection of garbage, he can sit on the right in the driver's cab, i.e., on the side on which the garbage cans have been placed.

The pouring unit 4 is connected to the chassis frame 3 of the truck in such a manner so that it is disposed between the driver's cab 1 and the container 5 and extends above the driver's cab 1.

The lifting and tipping apparatus comprises two U-shaped pivoted arms 6, 6' disposed on opposite sides of the driver's cab which have short legs that are pivoted on a pivot 46, which is disposed behind the driver's cab and is mounted in the lower portion of the pouring unit 4 or on the chassis, as shown in FIG. 3. Coupling members 7, 7' are provided, which are pivoted at one end to the free ends of the longer legs of the U-shaped arms 6, 6' and are interconnected by a carrying rail 8 which is parallel to the wheel axles of the truck. Coupling members 7, 7' are pivoted at their other ends to links 9, 9' of the link-lever system by which the rotation performed by the carrying rail 8 during the pivotal movement of the lifting arms 6, 6' is controlled in such a manner that the carrying rail undergoes substantially no rotation relative to the garbage truck until the rail has been pivotally moved approximately to the level of the upper portion of the driver's cab, after which the rail performs an accelerated rotation during the remainder of its pivotal movement. The link-lever mechanism will be explained more in detail hereinafter with reference to FIG. 9.

The U-shaped pivoted lifting arms 6, 6' are designed so that in the lower end position of the arms, the short legs are disposed behind the rear wall of the driver's cab and the the forward longer legs are disposed laterally of the forward portion of the driver's cab. The legs of each of the arms are connected by a cross-piece 10, which extends above the side doors of the driver's cab. As a result, the lifting arms do not obstruct the view of the driver of the opening and closing of the doors of the driver's cab.

Figures 4, 4A, 4B, 4C:
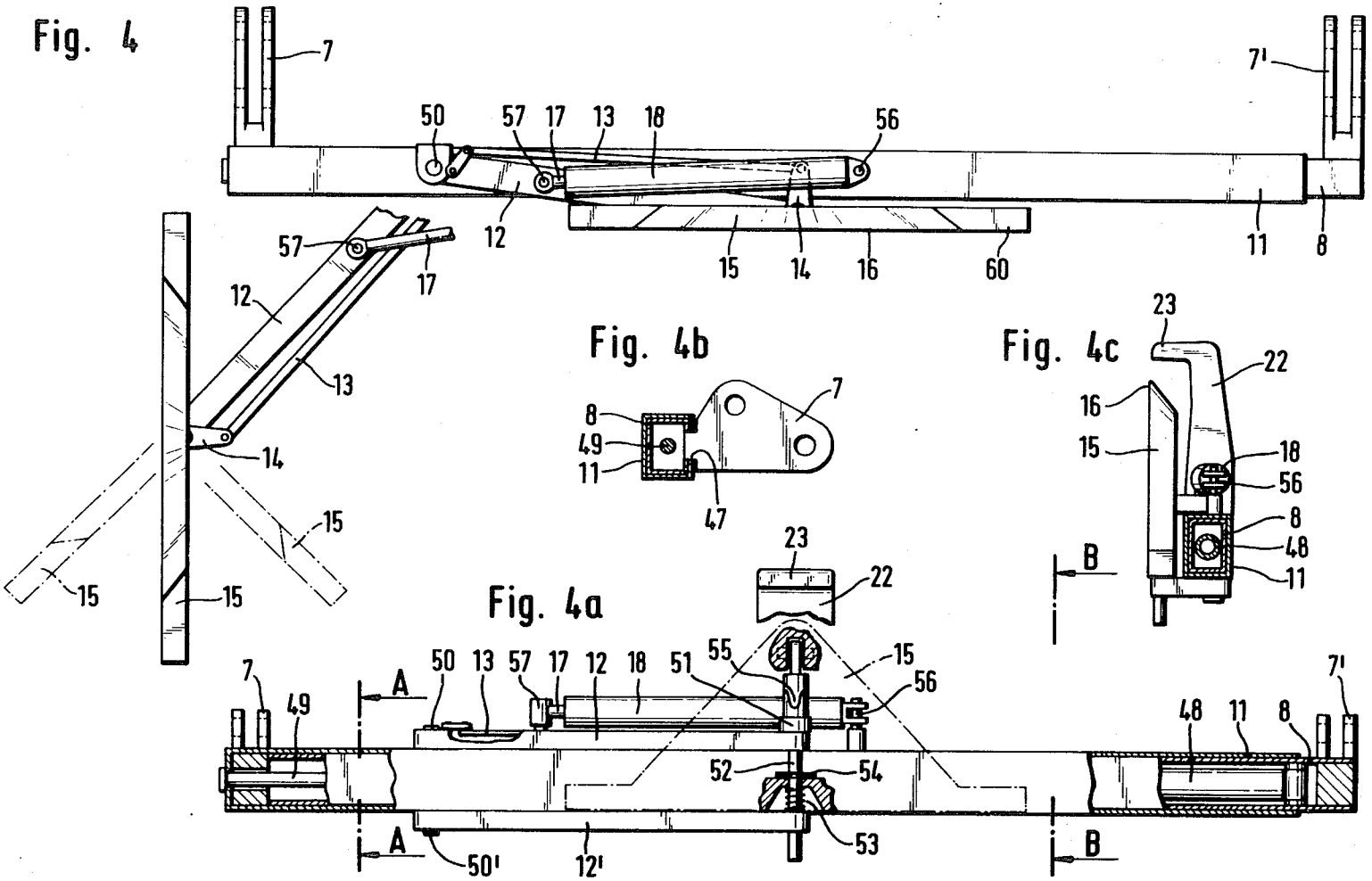
FIG. 4 is a top plan view showing the carrying rail of the lifting and tipping apparatus and the garbage can coupling means in inturned and outturned position.
FIG. 4*a* is a front elevation view showing the carrying rail of FIG. 4 partially in section.
FIG. 4*b* is a sectional view taken on line A—A of FIG. 4*a* and showing the carrying rail.
FIG. 4*c* is a sectional view taken on line B—B of FIG. 4*a* and showing the carrying rail.
Figure 5:
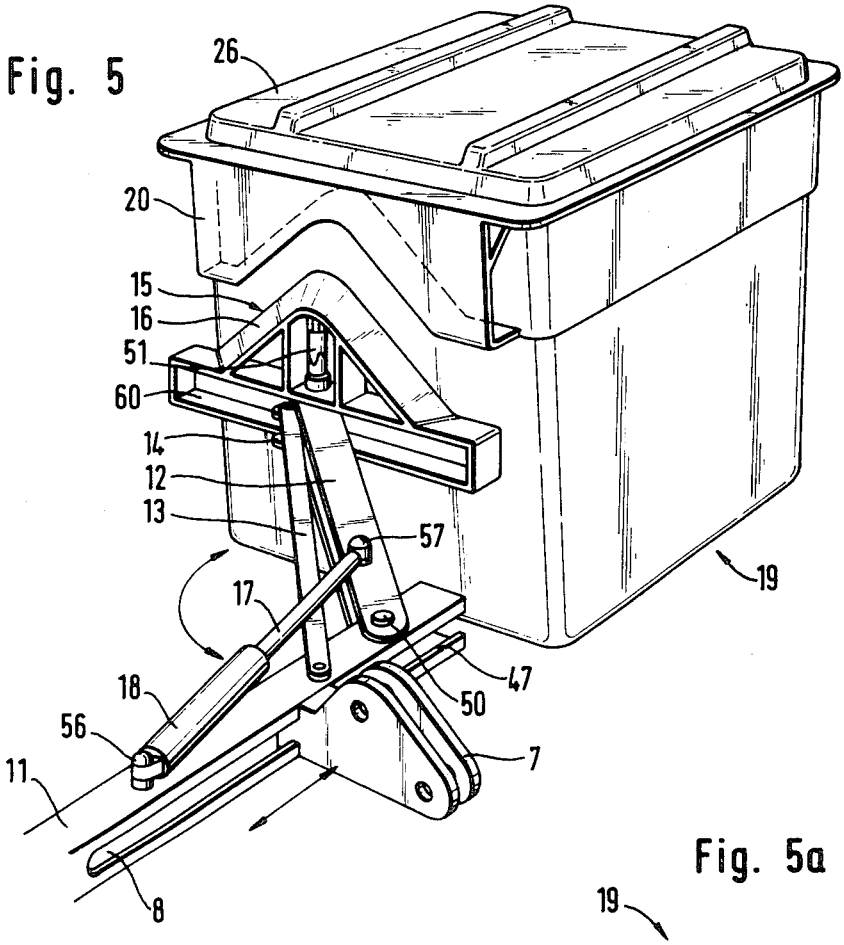
FIG. 5 is a partial perspective view showing a garbage can and the gripping device shown in FIG. 4 just before the can is gripped.
Figure 5A:
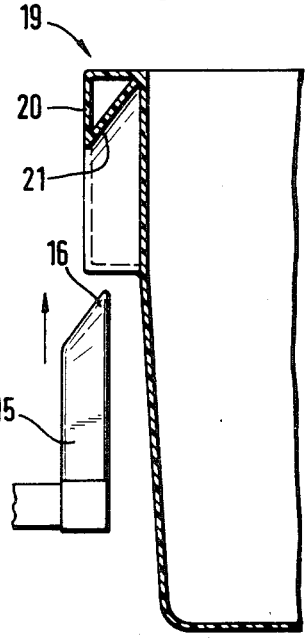
FIG. 5*a* is a partial diagrammatic sectional view showing the coupling portions of the garbage can and the coupling device.

As is clearly apparent from FIGS. 4 and 5, a profiled sleeve 11, which is rectangular in cross-section, is longitudinally slidably mounted on the box-section carrying rail 8. A hydraulic piston-cylinder unit for extending and retracting the profiled sleeve 11 is incorporated in the carrying rail 8. A main link 12 and an auxiliary link 13 are pivoted to the profiled sleeve 11 and are pivoted at their other ends to a coupling member 14, which carries a triangular gripping claw 15 having a wedge-shaped gripping edge 16. The piston rod 17 of a hydraulic cylinder 18 is pivoted to the main link 12. The hydraulic cylinder 18 is pivoted to the profiled sleeve 11 as is shown in FIG. 5 so that the gripping claw can be pivotally moved between an outer position and a position in which the claw 15 centrally engages the profiled sleeve 11.

To permit each garbage can 19 to be lifted and tipped it is provided at its top rim with a profiled reinforcing bar 20 formed at its lower edge with an angled undercut receiving groove 21, which is complementary to the wedge-shaped gripping edge 16 of the gripping claw 15. To couple the can 19 to the lifting and tipping apparatus the gripping claw 15 is introduced into the mating receiving groove 21 so that the claw 15 centers itself. When the can has been coupled to the gripping claw 15, the latter is pivotally moved to its lifting and tipping position, in which the claw 15 centrally engages the profiled sleeve 11. A latching member 22, (FIGS. 4*a* and 4*c*), which protrudes over the carrying rail 8, is secured to the latter or to the profiled sleeve 11 and has an angled upper hose 23 which extends over and engages the top rim of the can or the upper edge of the profiled reinforcing member 20 which is formed with the receiving groove 21, so that the can is latched to the lifting and tipping apparatus. The thus latched can 19 is raised in the direction of the arrow 24 in FIG. 2 and its contents are poured into the chute 25 of the pouring unit 4. Due to the kinematic arrangement of the link-lever mechanism for rotating the carrying rail 8, the can 19 initially remains in a substantially vertical orientation as it is raised so that no garbage can fall out of it. Since an accelerated rotation is imparted to the carrying rail 8 only when it is in close proximity to the chute 25, the cover 26 of the can then opens and the garbage is virtually thrown in the chute as the lifting arm or the can strikes against a stop, or the movement of the lifting arms is reversed.

When the garbage cans to be emptied have been placed along the right side of the street, they can be coupled to the lifting and tipping apparatus under the control of suitable control devices within the reach of the driver on his seat so that the collection of garbage can be effected by the driver of the truck alone without leaving his seat or performing hard or dirty work for the purpose.

A ramp 27 consisting of a curved metal plate extends above the driver's cab 1 toward the chute 25. The ramp is curved around a transverse axis of the garbage truck in such a manner that the carrying rail 8 and the profiled sleeve 11 move over the ramp 27 at a small distance therefrom as the container 19 is tipped. The carrying rail 8, or the profiled sleeve 11 is provided with a suitable scraping edge. Consequently, any garbage which has prematurely fallen out of can 19 onto ramp 17 will be pushed by the scraping edge into the chute 25 as the container 19 is raised towards the chute.

Chute 25 comprises sides walls 28, 29 and is succeeded by a space 30 for receiving the garbage which has been poured therefrom. The lower portion 31 of the receiving space constitutes a transfer chamber in which compacting ram 32 is reciprocable in the directions of the double-headed arrow 33. Compacting ram 32 is shown in an exaggerated width only for the sake of clarity and is provided at its top with a cover plate 34 which separates the transfer and compacting chamber 31 from the upper region of the receiving space 30 as the compacting ram 32 is advanced. During the retraction of the compacting ram 32, the cover plate 34 slides in a track over the driver's cab 1 as is shown in FIG. 1 so that additional garbage can now fall from the upper region of the receiving space 30 into the transfer and compacting chamber 31.

The compacting ram 32 pushes the garbage into the container 5 through an opening in the latter. The opening in the container can be closed by gates, not shown, which can be actuated by fluid-operated piston-cylinder units, not shown, and which are located in the pouring unit 4 and provided with suitable pawls and/or coupling means.

As is apparent from FIGS. 2 and 3 an auxiliary frame 36 lies on and is pivoted to the main frame 3 of the chassis. The pivot 37 of the pivoted frame 36 is carried by an angled extension 38 at the rear end of the pivoted frame and is guided in a slot 39 formed in the main frame 3. The pivoted frame 36 is provided at its forward end with a flat nose 87, which is adapted to extend below and engage an angle bar 88 connected to the main frame. In this manner pivoted frame 36 is locked to the main frame 3. The cylinder 89 of a fluid-operable piston-cylinder unit is pivoted to the main frame 3 and is provided with a piston rod pivoted to frame 36 by a pin 40. When suitable latching means have been released, the fluid-operable piston-cylinder unit 89 can be operated to initially push the pivot frame 36 to the rear on the main frame 3 until the pin 37 engages the rear end of the slot 39 in the position shown in FIG. 2. In that position the nose 87 has cleared the overlying flange of the angle member 88 so that the pivoted frame 36 can now be pivotally moved as is indicated in FIG. 2 in order to discharge the contents of the container.

Container 5 is provided at its forward end with a latch pin 41 which interlocks with a latch hook 42 of the pouring unit 4.

The container 5 is latched to the pivoted frame 36 by latching means 43 and is centered by laterally disposed jaws 44. When the latching means 41, 42, 43 have been released and the opening of the container has been closed, the container can be lifted from the garbage truck and transferred to suitable forwarding truck for forwarding to a suitable dump.

FIGS. 2 and 3 show also hydraulic cylinder 94 which is pivoted to the chassis and has a piston rod that is pivoted to the lever 45 for imparting a pivotal movement to the pivoted arms 6, 6' about the pivot 46.

The gripping unit of the lifting and tipping apparatus, inclusive of the gripping claw 15, will now be explained more in detail with reference to FIG. 4.

In the position shown in FIG. 4, the pivotal connections between the coupling members 7, 7' and the lifting arms 6, 6', on the one hand, and the outer links 9, 9', on the other hand, are separated. The profiled sleeve 11 has been slidably fitted onto the carrying rail 8, which interconnects the coupling members 7, 7'. In the embodiment shown by way of example, the profiled sleeve 11 can be extended only to the left in FIG. 4 and only to the right in FIG. 5 and the gripping claw 15 can be pivotally moved from its central position on the profiled sleeve only in the direction of that displacement. As a result, the driver of the garbage truck can take up and empty only garbage cans placed on the right side of the street. For this reason the garbage truck is provided with a steering wheel on the left for normal traffic in the street and also with a right-hand steering wheel for use during the taking and emptying of garbage cans.

As is apparent from FIG. 5 the profiled sleeve 11 is formed on the rear side with a slot 47 in its portion, so that the sleeve can be displaced to the right to protrude beyond the coupling member 7 by about 1.20 meters. This is apparent from FIG. 4*a*, which shows that the cylinder 48 of a hydraulic piston-cylinder unit is secured to the left-hand portion, when viewed in the direction of travel, of the box-section carrying rail 8. The piston rod of that piston-cylinder unit is secured to the extensible end of sleeve 11.

The upper and lower main links 12, 12' are pivoted by means of pins 50, 50' disposed on sleeve 11. The outer end of the link 12 is pivoted to a pin 51, which is secured to the coupling member 14. Pin 51 is formed with a bore in which a pin 52 carrying the gripping claw is longitudinally displaceable to a limited extent. Pin 52 is surrounded by a spring 53 which bears at its lower end on the lower main link 12' and at its upper end on a stop 54 which is connected to pin 52. The pin and the gripping claw 15 are held against a stop, not shown by means of spring 53 when the gripping claw 15 is not loaded. The tubular pivot pin 51 for the main link 12 is formed at its top end with mutually opposite grooves having side faces connected by rounded surfaces. Pin 52 on which the claw 15 is pivotally mounted is provided at its upper end with noses 55 which are complementary to the grooves of the pivot pin 51 and which are depressed into the grooves against the force of the spring 52 when the gripping claw 15 is loaded by a garbage can so that the gripping claw is then fixed to the coupling member 14. As is apparent from FIG. 4 the unloaded gripping claw can be pivotally moved between stops, not shown, through 45° to the left and right relative to the coupling member 14. When it is desired to pick up a garbage can, it is sufficient to impart a pivotal movement to the gripping claw 15 towards the front side of the garbage can which is provided on the front side of the can with the receiving groove 21. During that operation, the gripping claw 15 assumes such a position relative to the front wall of the can that the claw is in substantially snug contact with the wall. When the gripping claw is subsequently raised, its wedge-shaped gripping edge 16 enters the receiving groove 21 and will be centered in the latter in the transverse direction if the apex of the gripping edge 16 is initially disposed in the receiving groove 21. When the gripping claw is then raised further, it is loaded by the weight of the garbage can 19 so that the spring 53 is depressed, the noses 55 slip into the mating grooves and the claw is locked to the coupling member 14.

As is shown in FIG. 4, the auxiliary link 13 is pivoted to the coupling member 14 and the profiled sleeve 11 at such locations that the gripping claw 15 is pivotally movable between its central position, in which the claw is closely spaced from the profiled sleeve 11, and its outer position shown in FIG. 4.

The respective locations 56, 57 at which the cylinder 8 is pivoted to the profiled sleeve 11 and the piston rod 17 is pivoted to the link 12 are apparent from FIG. 4.

It is apparent from FIG. 4*c* that the latch rod 22 is centrally connected to the profiled sleeve 11. When the gripping claw 15 is in its inturned position, as shown, the rim of the can or the profiled bar 20 formed with the receiving groove 21 is latched by being gripped between the rounded apex of the gripping claw 15 and the overlying tongue 23 of the latch rod 22.

As is most clearly apparent from FIG. 5, the gripping claw 15 consists of a triangular member which is provided at its base with a profiled lower crosspiece 60. The triangle is isosceles and is rounded at its apex. The gripping edges 16 are constituted by the sides and the apex of the triangle and are inwardly and downwardly inclined.

The can 19 is of conventional type and is provided with a pivot for the hinged cover 26 on that side which is opposite to the coupling bar 20.

Figure 5B:
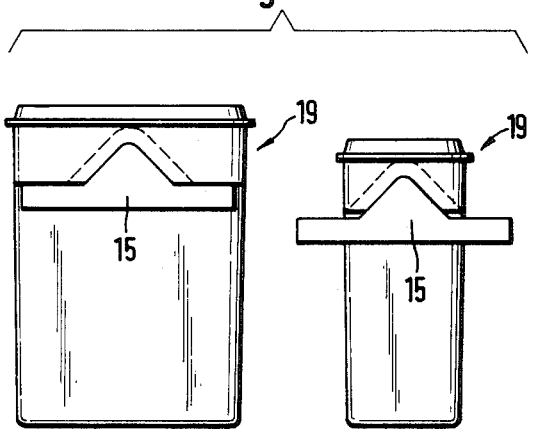
FIG. 5*b* is a diagrammatic view showing two garbage cans differing in size with the coupling elements in coupling position.

Garbage cans differing in size may be provided with the same coupling bar 20 so that the gripping claw 15 of the lifting and tipping apparatus may be used to pick up and tip cans differing in size. For instance, FIG. 5*b* shows a relatively large can and a smaller can of the size generally used in households.

Figure 6:
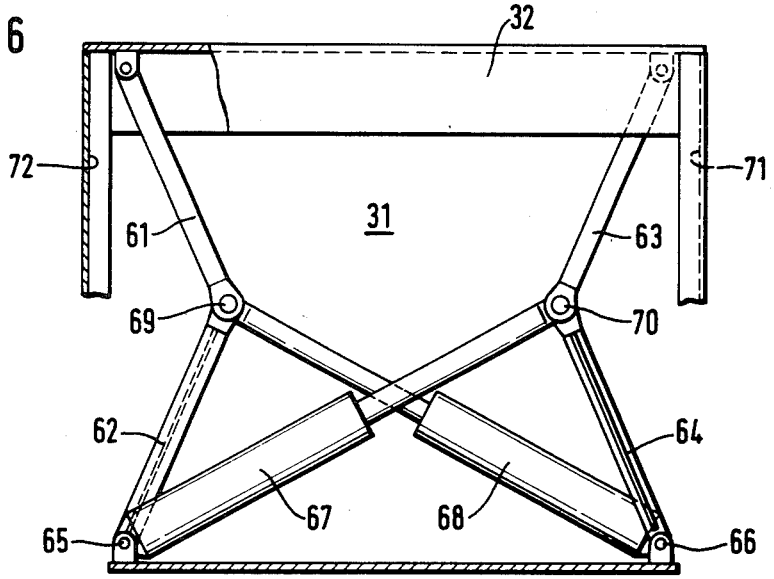
FIG. 6 is a plan view showing the conveying and compacting apparatus.
Figure 7:
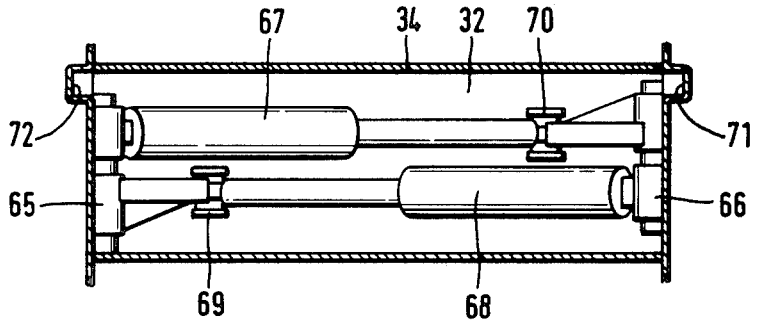
FIG. 7 is a rear view in elevation showing the conveying and compacting apparatus of FIG. 6.
Figure 8:
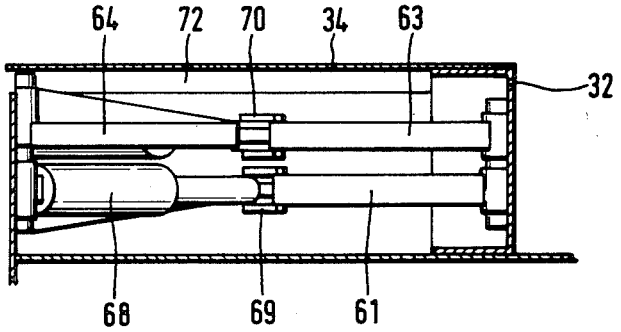
FIG. 8 is a side view in elevation showing the conveying and compacting apparatus of FIG. 6.

The conveying and compacting apparatus will now be explained more in detail with reference to FIGS. 6 to 8.

The extent to which the compacting ram 32 can be displaced in the chamber 31 is apparent from FIG. 2. The compacting ram 32 is connected to two toggle joints constituted by arms 61, 62 and 63, 64 to the forward wall defining the chamber 31. The toggle arms 62, 64 are pivoted on pivot pins 65, 66 provided adjacent the forward wall defining the chamber 31. The cylinders 67, 68 of piston-cylinder units are also pivoted to the pins 65, 66. The piston rods of these units are pivoted to hinges 69, 70 so as to cross each other.

The compacting ram 32 has a rectangular cross-sectional shape which conforms to the cross-section of the chamber 31. Ram 32 is connected to the cover plate 34 of the chamber and is guided in laterally disposed tracks 71, 72. Cover plate 34 and compacting ram 32 confine the transfer and compacting chamber 31 so that the toggle joints and the piston-cylinder units will not be soiled by additional garbage falling into chamber 31. In retracted position the toggle joint and piston-cylinder mechanism has only a short axial length so a compact arrangement can be used.

Figure 9:
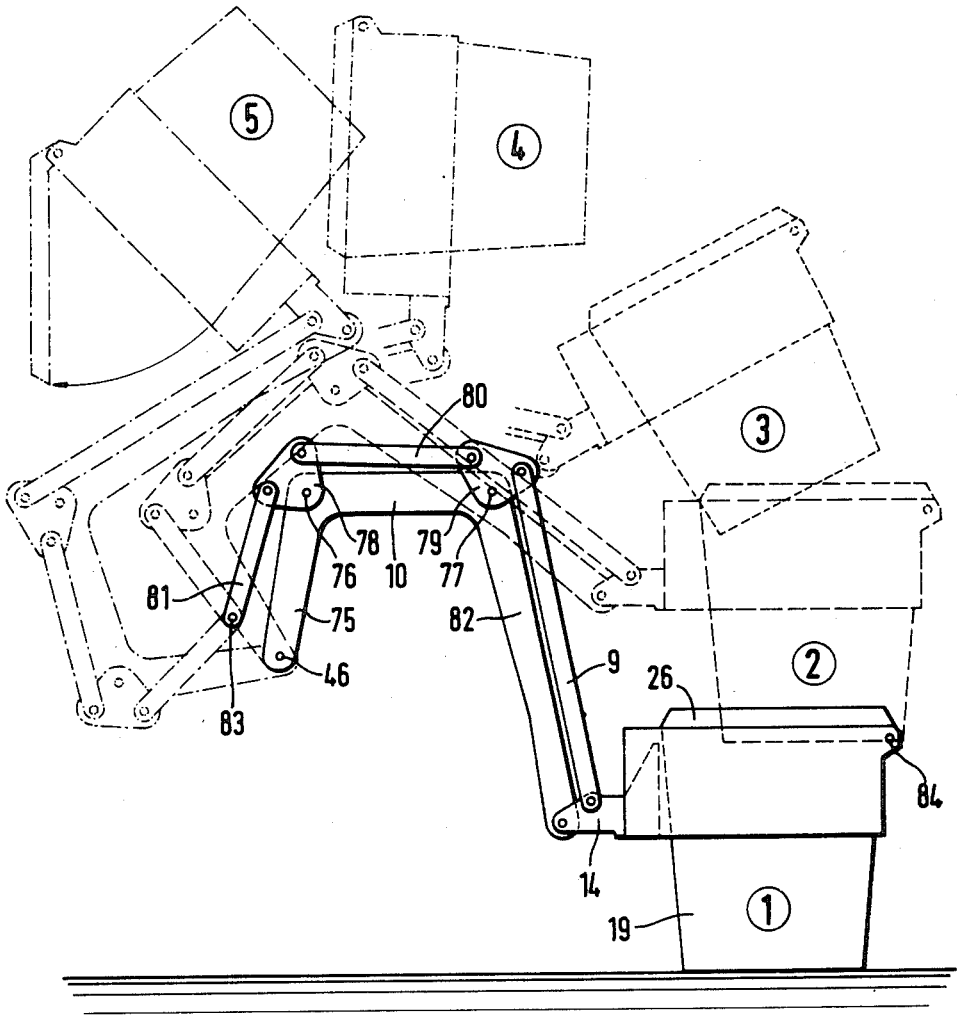
FIG. 9 is a diagrammatic side view elevation showing the lifting arm, as well as the link-lever mechanism for controlling the carrying rail during its pivotal movement, and the coupled garbage can with these elements shown in different positions in broken lines.

The kinematic arrangement of the link-lever mechanism associated with the lifting arms 6, 6′ is apparent from FIG. 9, in which a can is shown in five positions, which are successively assumed by the can starting from the position in which the can is picked up to the position in which it is tipped. The shorter leg 75 of each lifting arm is movably mounted on the pivot 46 which is fixed to the frame. Adjacent to the ends of the crosspiece 10, which connects the legs of each lifting arm 6, 6′, the approximately triangular lever plates 78, 79 are pivoted on pivot pins 76, 77 in such a manner that the lever plates 78, 79 protrude outwardly beyond the corner portions of the lifting arms. Coupling rods 9, 80, 81 are pivoted to the lever plates near their base corners. Coupling rod 80 extends approximately parallel to crosspiece 10 and connects the two lever plates 78, 79, as illustrated. Coupling rod 9 extends approximately parallel to the longer leg 82 and is pivoted to coupling member 14 associated with the carrying rail. The inner coupling rod 81 is pivoted at its outer end to the lever plate 78 and at its inner end by the pin 83 to the frame. The desired lifting and tipping movement of the can 19 is indicated by container positions 1 to 5. The pivot 84 for the can cover is disposed on that side of the can which is opposite to the coupling members so that the cover will automatically open as the can is tipped in position 5.

Each of coupling rods 9, 80 and 81 together with the coupling member 14, the lever plates, the pivotal connections at the frame, and the legs and the crosspiece of the associated lifting arm constitute a four-bar linkage so that a linkage comprising levers and coupling rods is achieved which has the described characteristics.

We claim:

1. A motor-driven garbage truck having a chassis frame including front and rear axles and a driver's cab including a front windscreen mounted on said chassis frame and comprising a garbage container provided with a receiving opening and a closure member therefor and separable coupling elements, a pouring unit permanently mounted on said truck in a forward portion thereo and a pouring hute leading to a receiving space, lifting and tipping apparatus for picking up a garbage can and discharging the contents thereof into said chute, and a conveying and compacting apparatus for transferring garbage from said receiving space into said container through said receiving opening, said pouring unit being disposed in part above said driver's cab and in part between said driver's cab and said container, said chute being disposed in a region extending behind and above said driver's cab, said lifting and tipping apparatus comprising at least one lifting arm pivotally movable about a transverse pivot carried by said pouring unit or said chassis frame, said lifting arm carrying at its free end a carrying rail disposed parallel to said transverse pivot and which is pivotally movable between a pick-up position, in which said rail is disposed below and in front of said driver's cab, and a pouring position, in which said rail is disposed above and behind said driver's cab, said rail being provided with displaceable or pivotally movable extensible means for coupling to and gripping a garbage can, said displaceable or pivotally movable extensible means for coupling and gripping a garbage can including a link in the form of an arm, said link being eccentrically mounted on a profiled member slidably mounted on said carrying rail and extensible beyond at least one end of said carrying rail for pivotal movement about a vertical axis, the link at its free end carrying a triangular shaped self-centering claw member having beveled edges which cooperate with a similar shaped member on said garbage can for picking up said garbage can and means for pivotally moving said claw member between an outer position, in which said carrying rail or said profiled member picks up said garbage can and an inner position in which said lifting and tipping apparatus transports said garbage can to said pouring opening.

2. A garbage truck according to claim 1, characterized by the fact that it has a short wheelbase for high maneuverability.

3. A garbage truck according to claim 1, characterized by the fact that the driver's cab is disposed in front of the front axle.

4. A garbage truck according to claim 1 characterized by the fact that it is provided with left-hand and right-hand steering wheels.

5. A garbage truck according to claim 1, characterized by the fact that the lifting and tipping apparatus comprises two U-shaped members constituting two lifting arms disposed on opposite sides of the driver's cab, each having a short leg and a long leg connected by a crosspiece, the transverse pivot for the lifting arm being disposed near the free ends of the short legs, coupling members carrying te carrying rail are pivoted at one end to the free ends of the long legs and the other ends of said coupling members are connected to the pouring unit or said truck by means of coupling rods pivotally connected to levers mounted adjacent to the inner ends of the long legs, and the connection of the other ends of said coupling members to said pouring unit or said truck are arranged so that said rail when pivotally moving to a position above and in front of the driver's cab will perform substantially no rotation relative to said driver's cab and will perform an accelerated rotary movement during its remaining pivotal movement to the chute.

6. A garbage truck according to claim 5, characterized by the fact that each lever comprises an approximately triangular plate which is pivoted adjacent its apex to one of the lifting arms near the corners of the crosspiece connecting the legs, the coupling rods are pivoted to the triangular plates near their base corners and when said lifting arms are in their lower end position said coupling rods extend approximately parallel to the associated legs and the crosspieces of said lifting arms.

7. A garbage truck according to claim 1, characterized by the fact that the pick-up claw is guided on and axially displaceable along a vertical axis against a spring force into a lower end position and is adapted to be latched to a pivot pin in the lower end position.

8. A garbage truck according to claim 1 characterized by the fact a sheet metal ramp, curved around a transverse axis of the truck, adjoins the forward edge of the chute and extends to a region above the front windscreen of the driver's cab, said ramp having a curvature conforming to a curved path traversed by the carrying rail or profiled member mounted thereon and said carrying rail or said profiled member is provided with an edge for sliding contact with said ramp.

9. A garbage truck according to claim 1 characterized by the fact that the pick-up claw has the configuration of an isosceles triangle having its open apex at the top and is provided with an outwardly and upwardly inclined gripping edge formed by the upper sides of said pick-up claw.

10. A garbage truck according to claim 1, characterized by the fact that an auxiliary frame lies on and is pivoted to the chassis frame of said truck, the container is releasably latched to said auxiliary frame and such auxiliary frame is pivoted on pins which are displaceable in slots formed in the rear portion of the chassis frame of said truck, said auxiliary frame being provided at its forward end with a nose which in the forward end position of said auxiliary frame extends below and engages a stop plate of said chassis frame, and said auxiliary and chassis frames are interconnected by an inclined hydraulic piston-cylinder unit in such a manner that the nose is disengaged from an overlying stop plate before the pivotal movement of said auxiliary frame begins.

11. A garbage truck according to claim 3 characterized by the fact that it is provided with left-hand and right-hand steering wheels.

12. A tipping device for motor-driven garbage-collecting trucks comprising a holding claw adapted to cooperate with edge portions of garbage cans provided with open ends and upper sides and with a receiving pocket on the open ends thereof, and a gripping arm, said tipping device characterized by the fact that said holding claw is a plate having the shape of an isosceles triangle having an upwardly directed vertex and the upper sides of which form inwardly tapering, beveled gripping edges which cooperate with said receiving pocket on said garbage cans, said receiving pocket having a complementary undercut surface and being formed by a section member located on and reinforcing the edge portion of said garbage cans at an open end, said holding claw being attached to a free end of said gripping arm.

* * * * *